United States Patent [19]

Miyamoto et al.

[11] 4,314,438

[45] Feb. 9, 1982

[54] SPINNING UNIT FOR OPEN-END SPINNING MACHINE

[75] Inventors: Noriaki Miyamoto; Masao Shiraki, both of Kariya; Kinpei Mitsuya, Aichi, all of Japan

[73] Assignee: Kabushiki Kaisha Toyoda Jidoshokki Seisakusho, Kariya, Japan

[21] Appl. No.: 91,496

[22] Filed: Nov. 5, 1979

[30] Foreign Application Priority Data

Nov. 13, 1978 [JP] Japan ..... 53/156538
Nov. 13, 1978 [JP] Japan ..... 53/156539

[51] Int. Cl.[3] ..... D01H 7/882
[52] U.S. Cl. ..... 57/58.89
[58] Field of Search ..... 57/58.89–58.95

[56] References Cited

U.S. PATENT DOCUMENTS

| | | | |
|---|---|---|---|
| 3,367,099 | 2/1968 | Kubovy et al. | 57/58.89 |
| 3,457,716 | 7/1969 | Storek et al. | 57/58.89 |
| 3,698,175 | 10/1972 | Dykast | 57/58.89 |
| 3,837,153 | 9/1974 | Didek et al. | 57/58.89 X |
| 3,874,751 | 4/1975 | Okubo et al. | 57/58.89 X |
| 3,882,666 | 5/1975 | Muller | 57/58.89 X |
| 3,981,132 | 9/1976 | Miyazaki et al. | 57/58.89 |
| 4,070,813 | 1/1978 | Quandt et al. | 57/58.89 |

*Primary Examiner*—John Petrakes
*Attorney, Agent, or Firm*—Wenderoth, Lind & Ponack

[57] ABSTRACT

A spinning unit for an open end spinning machine is disclosed. The unit includes a rotor having a short cylindrical portion defining a central aperture, a frustoconical portion connected at one end to and converging toward the cylindrical portion, and a portion connected to the other end of the frustoconical portion with air discharge openings. The unit further includes a casing having a first portion, and a second portion connected to the first portion of the casing and surrounding the portion of the rotor connected to the other end of the frustoconical portion to define an annular chamber into which air is discharged through the air discharge openings during rotation of the rotor. The first portion has an inner surface substantially surrounding both the cylindrical and frustoconical portions of the rotor in spaced relationship therewith thereby to provide a relatively long and narrow bent passage defined between the first portion of the casing and the cylindrical and frustoconical portions of the rotor and extending between the central aperture of the rotor and the chamber of the casing.

3 Claims, 9 Drawing Figures

SPINNING UNIT FOR OPEN-END SPINNING MACHINE

BACKGROUND OF THE INVENTION

This invention relates to spinning units for an open-end spinning machine and, more particularly, to prevention of entrance of once discharged dirt and flies into the rotors of the spinning units.

In general, each spinning unit of an open-end spinning machine includes a rotor with discharge openings through which air is ejected during rotation of the rotor. The rotor is surrounded by a casing or cover which is open at the bottom for the discharge of ejected air. The rotor has a frustoconical portion converging from the largest diameter portion of the rotor toward the axis thereof, and a short cylindrical portion defining a large center aperture. The casing has a sealing wall disposed about the cylindrical portion of the rotor in a manner allowing the rotor's rotation.

The spinning unit further includes a stationary means having a closure portion closing the center aperture defined by the rotor's cylindrical portion.

In such a spinning unit, upon rotation of the rotor, air present in the rotor is ejected through the discharge openings by the centrifugal force applied thereto, thus creating a negative pressure condition in the rotor, which condition causes a flow of air toward the inside of the rotor to be developed in a fiber inlet channel formed in the stationary means. Therefore, individual opened fibers as well as the flow of air are fed into the rotor through the inlet channel, and formed into a yarn at the largest diameter portion of the rotor. The resulting yarn is discharged from the rotor through an outlet channel formed in the stationary means.

In order to allow the negative pressure created in the rotor to operate on the fiber inlet channel of the stationary means as effectively as possible, a conventional spinning unit has been generally provided with a labyrinth between the short cylindrical portion of the rotor and the sealing wall of the casing. Such a labyrinth is shown in U.S. Pat. No. 3,874,751, for example. However, the labyrinth can result in various disadvantages including entrance of once discharged flies, dirt and so on into the labyrinth from the side of the casing, and much difficulty in forming the labyrinth in the associated portions.

SUMMARY OF THE INVENTION

It is therefore a principal object of this invention to provide a spinning unit for an open-end spinning machine, which can eliminate the above disadvantages of the prior art arrangement by a simple provision for preventing once discharged dirt and flies from re-entering the rotor of the spinning unit through a center aperture of the rotor.

In brief, a spinning unit according to the present invention comprises a rotor having a short cylindrical portion to define a center aperture and a frustoconical portion connected to and converging toward the cylindrical portion, and a casing or cover surrounding the rotor. The rotor further includes a portion having discharge openings formed therein, through which air is discharged during rotation of the rotor. The casing defines a chamber to receive the air discharged from the rotor through the discharge openings. To keep the central aperture of the rotor as far as possible away from the chamber, the casing cooperates with the rotor to provide a relatively long and narrow bent passage therebetween, which has a portion, on the side of the chamber, inclined radially outwardly toward the chamber with respect to the axis of the rotor. The inclined portion of the passage may have a varying width, which increases progressively in going from the aperture side to the discharge chamber side.

BRIEF DESCRIPTION OF THE DRAWINGS

This invention will become more readily apparent from the following detailed description of preferred embodiments thereof shown, only by way of example, in the accompanying drawings, in which similar reference numerals denote corresponding parts throughout the figures and wherein.

DESCRIPTION OF THE EMBODIMENTS

Figure 6B:
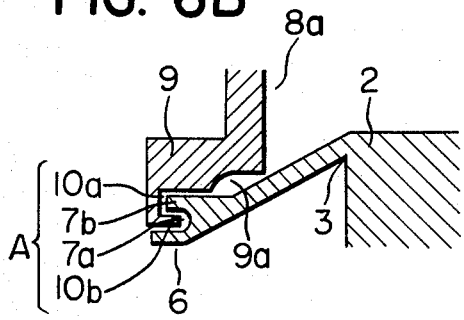
FIGS. 6A and 6B are views corresponding respectively to FIGS. 1 and 2, showing a typical prior art arrangement.
Figure 6A:
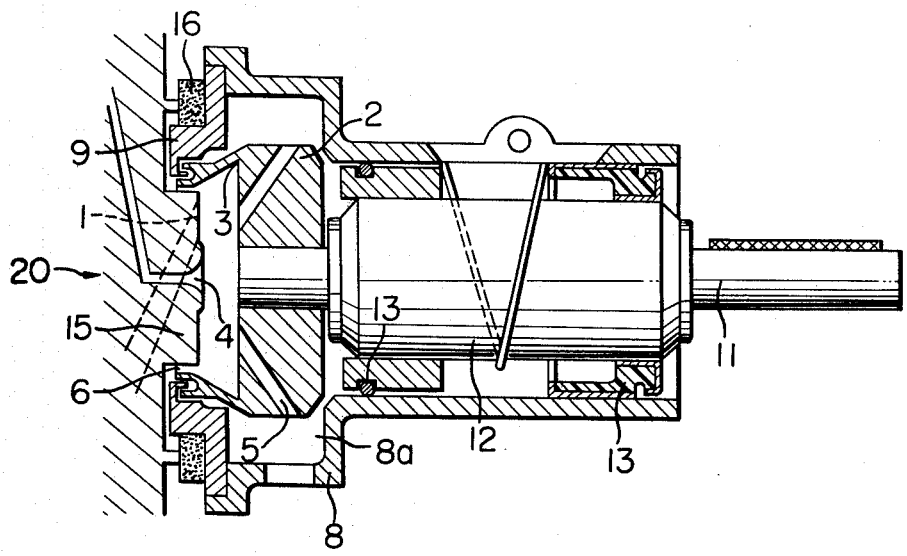

Referring to FIGS. 6A and 6B, there is shown a typical prior art arrangement, which will be explained hereafter to facilitate the understanding of this invention. In FIG. 6A, each spinning unit for an open end spinning machine generally includes a rotor 2 defining a rotor chamber into which individual opened fibers are fed through a fiber inlet channel 1 and directed, while sliding along the inner frustoconical surface of the rotor 2, toward the maximum inner diameter portion 3 of the same, at which they are formed into a yarn. The formed yarn is then discharged out of the rotor through a fiber discharge channel 4. Both channels 1 and 4 are formed in a body of stationary means generally indicated by reference numeral 20. The body 20 includes a closure portion 15 slightly extending into the rotor 2 to close a central aperture 6 of the same. Provided in the bottom of the rotor 2 are air discharge openings 5 which extend radially outward and permit air within the rotor 2 to pass outward therethrough due to centrifugal force applied to the air during rotation of the rotor 2. Upon such discharge of air within the rotor 2, the inside of the latter comes to be in a condition of negative pressure, which causes a flow of air accompanied by the opened fiber and directed toward the inside of the rotor to be developed in the fiber inlet channel 1.

In order that the negative pressure in the rotor 2 can effectively affect the development of the air flow in the fiber inlet channel 1, it has been proposed to form a labyrinth A around the rotor's aperture 6, which labyrinth comprises, as best shown in FIG. 6B, an annular coaxial depression *7a* and projection *7b* formed in the end surface of the short cylindrical portion defining the aperture 6, and an annular coaxial depression 10*a* and projection 10*b* formed in a seal ring 9, which is attached to a cover or casing 8 to seal a discharge chamber 8*a* surrounded by the casing 8. The annular depressions 7*a* and 10*a* receive the annular projections 7*b* and 10*b*, respectively, in axially and radially spaced relationship therewith so as to provide a zigzag passage or clearance having a limited width.

However, various disadvantages have resulted from the prior art arrangement. Since the aforementioned labyrinth is in fluid communication through a relatively extensive vacancy 9*a* with the chamber 8*a* and is positioned relatively close to the chamber 8*a*, undesirable matter or debris, such as flies and dirt once discharged from the rotor 2 through the discharge openings 5, can enter the labyrinth through the vacancy 9*a*. In other words, since the inside of the rotor 2 is in a negative pressure condition while the chamber 8*a* is in a positive pressure condition because of the air discharge from the inside of the rotor through the openings 5 into the chamber 8*a*, undesirable matter once discharged through the openings together with the air are apt to be forced into the labyrinth under the positive pressure in the chamber 8*a*. After a relatively short duration of the spinning machine's operation, a considerable amount of flies and dirt will be collected in the labyrinth so that the rotation of the rotor may be adversely affected by the trapped flies and dirt. In such a case, it is necessary to disassemble the spinning unit concerned to clear away the trapped flies and dirt. This is time consuming and troublesome. Furthermore, the labyrinth consisting of the zigzag passage not only involves difficulty in forming it, but also requires a high machining technique particularly where a bearing 12 to support a rotor shaft 11 for rotation is supported by elastic members 13, because the depressions and projections of the labyrinth must not come into contact with each another during possibly eccentric rotation of the rotor shaft 11.

The aforementioned disadvantages of the prior art arrangement can be eliminated by the present invention, of which various embodiments are shown in FIGS. 1 to 5.

Figure 1:
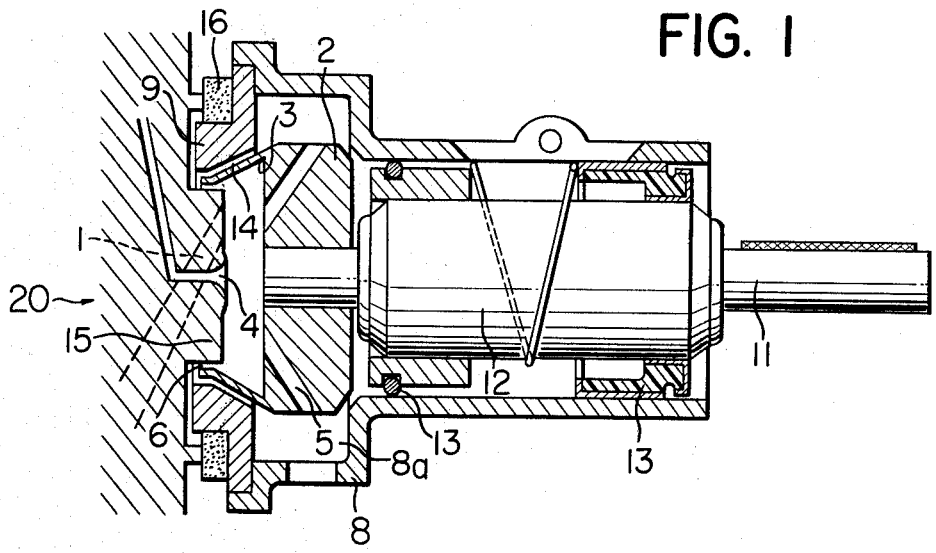
FIG. 1 is a side elevational view showing, partly in section, a spinning unit for an open end spinning machine incorporating this invention.
Figure 2:
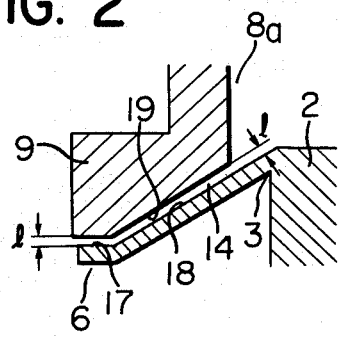
FIG. 2 is a sectional view of the essential parts of the spinning unit shown in FIG. 1.

Referring to FIGS. 1 and 2, as in the prior art arrangement, there is a rotor 2 having a short cylindrical portion defining an aperture 6, into which the closure portion 15 of a body 20 centrally extends with a narrow spacing between the inner surface of the rotor's cylindrical portion and the outer cylindrical surface of the closure portion 15 to restrict any flow of air passing through the spacing. To isolate the aperture 6 from the outside of the body 20, a seal member 16 is disposed between the body 20 and an annular wall portion 9 of a casing 8 surrounding the rotor 2.

According to this invention, a relatively long and narrow passage 14 is defined by a cylindrical outer surface 17 and a frustoconical outer surface 18 of the rotor and an inner surface 19 of the annular wall portion 9 surrounding the rotor's cylindrical and frustoconical portions to cause the aperture 6 to be fluidly isolated from the chamber 8*a*. As best shown in FIG. 2, the narrow passage 14 can be obtained by forming the inner surface 19 of the wall portion 9 so as to extend along both the cylindrical outer surface 17 adjacent to the rotor's aperture 6 and the frustoconical outer surface 18 connected thereto. Since one end of the passage 14 away from the aperture 6 is adapted to extend as far as possible toward the chamber 8*a*, the distance between the aperture 6 and the chamber's boundary can be increased.

With such an arrangement constructed in accordance with the present invention, because of the increased distance between the aperture 6 and the boundary of the chamber 8*a*, the narrow passage 14 gives much resistance to the positively pressurized air in the chamber 8*a* when it back flows therethrough, thus causing the back flow from the chamber 8*a* through the passage 14 to the aperture 6 to be substantially prevented. Even if any back flows occurs, it will be prevented from reaching substantially into the passage 14, because the passage 14 is bent at the junction of the rotor's cylindrical outer surface 17 and frustoconical outer surface 18. Furthermore, it is an important feature of this invention that the passage 14 is so inclined as to be gradually spaced apart from the axis of the rotor 2 as a position in the passage 14 approaches to the chamber 8*a*. This feature causes the flow of air generated in the passage 14 as an accompaniment of the rotor's rotation to be directed toward the chamber 8*a* by means of differential centrifugal force, thereby forcing back the positively pressurized air, which hypothetically has flowed from the chamber 8*a* into the passage 14, toward the chamber 8*a*.

Thus, it is apparent that the aforementioned bent and inclined passage 14 having sufficient length serves favorably to increase the distance between the rotor's aperture 6 and the boundary of the chamber 8*a* thereby to fluidly isolate the aperture 6 from the chamber 8*a*.

Figure 7:
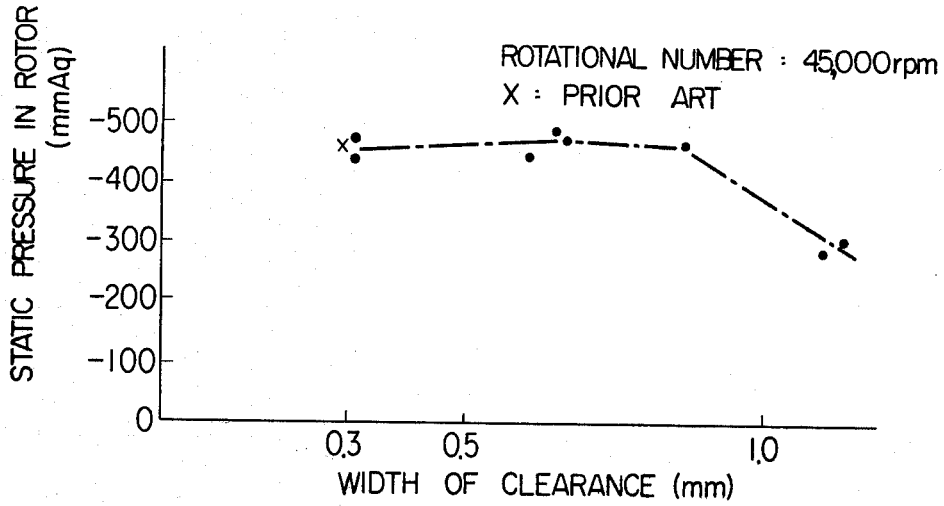
FIG. 7 is a graphic view illustrating the relationship between changes in static pressure within a spinning rotor and in width of a passage to prevent the back flow of once discharged flies and dirt into the rotor.
Figure 8:
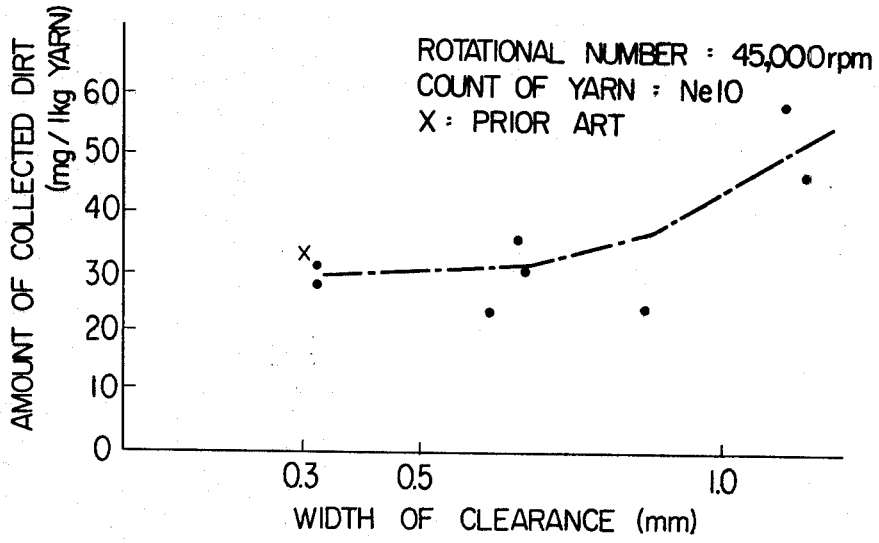
FIG. 8 is a graphic view illustrating the relationships between changes in the amount of dirt collected in the rotor and in the width of the passage.

With respect to the width or thickness l of the annular passage 14, it has been experimentally decided that its minimum value is to be 0.3 mm or more in view of the facts that the rotor 2 in rotation must not be in contact with the wall portion 9 and its rotation must not be disturbed by a frictional resistance to air present in the passage 14. To find an allowable maximum value of the passage's width, changes in static pressure within the rotor and in the amount of dirt and flies collected in the rotor have been measured for various widths of the passage 14. According to the experiments on a spinning rotor rotating at a speed of 45,000 r.p.m. and having an outer frustoconical surface 18 with a 30° inclination angle relative to the axis of the rotor, it has been found that where the static pressure within the rotor decreases below −300 mmAq, the amount of air for transporting individual opened fibers in the fiber inlet channel 1 becomes insufficient to maintain the desired straightness of each opened fiber, resulting in a decreased yarn strength. The decrease in static pressure of the spinning rotor appears to be due to the back flow of air from the chamber 8*a* into the aperture 6. Therefore, it can be understood from FIG. 7 that the passage 14 is to be designed to have a maximum width of 1.0 mm or less so as not to cause the static pressure to be decreased below −300 mmAq. With respect to the amount of dirt and flies collected in the rotor, it has been found that although the collected amount abruptly increases, as shown in FIG. 8, when the width l exceeds 1.0 mm, the amount for a width of just 1.0 mm does not unfavorably affect either yarn quality or spinning operation.

Thus, it has been proved that the width of the passage 14 is to be within the limits 0.3 to 1.0 mm, and that if it falls within such limits, the rotor's static pressure and the amount of collected dirt would both be extremely close to those (indicated by the mark "X" in FIGS. 7 and 8) in the case of the prior spinning rotor with the labyrinth A of 0.3 mm width clearance.

Figure 3:
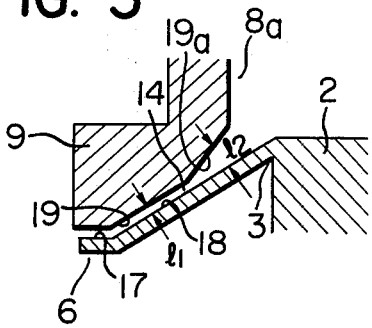
FIGS. 3 to 5 are sectional views corresponding to FIG. 2, showing different modifications of the invention.
Figure 4:
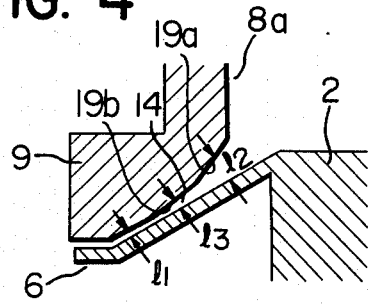
Figure 5:
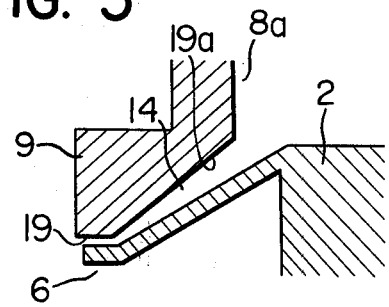

FIGS. 3 to 5 show modifications of the embodiment shown in FIGS. 1 and 2, which modifications disclose a passage 14 having a portion of varying width on the side of the chamber 8*a*. The width is so selected as to progressively increase as the clearance 14 approaches the chamber 8*a*. Therefore, the flow of air generated in the clearance 14 due to the differential centrifugal force as above-described with reference to the embodiment shown in FIGS. 1 and 2 can be subject to less resistance when such air flow is directed toward the chamber 8*a*, and the flowing of the air through the clearance 14 toward the chamber 8*a* can be greater facilitated, resulting in effective prevention of the back flow of the air from the chamber 8*a* into the aperture 6.

In FIG. 3, a portion 19*a* of the wall's surface 19 provides the continuously varying width $l_2$ with the largest value at the boundary of the chamber 8*a* and the smallest value at the junction with the remaining portion of the surface 19, which has a constant width of $l_1$. The lower limit of the width $l_1$ is 0.3 mm and if the value of the width $l_1$ is equal or close to 0.3 mm, the upper limit of the width $l_2$ may exceed 1.0 mm to the extent that there occurs no unfavorable influence on yarn quality or spinning operation. In FIG. 4, the portion 19*a* is connected to the remaining portion through a transient surface portion 19*b*, which also has a varying width of $l_3$ with the largest value at the junction with the innermost end of the surface portion 19*a*.

The number of transient surface portions is not to be limited to one and may be selected at will. The surface 19 may include a curved surface portion or portions.

FIG. 5 shows the modified arrangement in which the surface portion 19*a* extends to the end of the short cylindrical portion of the surface 19.

In view of the above, it will be apparent that many modifications and variations are possible in light of the above teachings. It therefore has to be understood that within the scope of the appended claims, the invention may be practiced other than as specifically described.

What we claim is:

1. A spinning unit for an open end spinning machine, said unit comprising:

a rotor including a short cylindrical portion defining a large central aperture, a frustoconical portion defining a rotor chamber and having a first end connected to said cylindrical portion, and a bottom portion closing said rotor chamber and connected to a second end of said frustoconical portion, said frustoconical portion diverging from said first end thereof to said second end thereof;

a casing surrounding said rotor and having connected first and second portions, said second portion surrounding said bottom portion of said rotor and defining therewith an annular chamber;

said bottom portion of said rotor having therein air discharge opening means extending from said rotor chamber to said annular chamber for, upon rotation of said rotor, discharging air and accompanying debris from said rotor chamber into said annular chamber, and for thereby creating a negative pressure condition in said rotor chamber and a positive pressure condition in said annular chamber;

said first portion of said casing having an inner surface substantially outwardly surrounding both said cylindrical and frustoconical portions of said rotor in spaced relation therewith to thereby define therebetween passage means for preventing said debris in said annular chamber from returning to said rotor chamber, said passage means comprising an annular relatively long and narrow bent passage extending between said central aperture of said rotor and said annular chamber, said inner surface of said first portion of said casing comprising at least one diverging surface portion opening into said annular chamber, said surface portion extending toward said annular chamber and diverging away from said frustoconical portion of said rotor; and stationary means for openably closing said central aperture of said rotor.

2. A unit as claimed in claim 1, wherein said passage comprises a cylindrical portion defined between said cylindrical portion of said rotor and a cylindrical portion of said inner surface of said first portion of said casing.

3. A unit as claimed in claim 2, wherein said cylindrical portion of said passage has a width of from 0.3 to 1.0 mm.

* * * * *